United States Patent [19]

Larsson

[11] 3,992,279

[45] Nov. 16, 1976

[54] ELECTRODE ASSEMBLY

[75] Inventor: Karl-Georg Larsson, Sundsvall, Sweden

[73] Assignee: KemaNord AB, Sundsvall, Sweden

[22] Filed: Aug. 20, 1974

[21] Appl. No.: 498,894

[30] Foreign Application Priority Data

Aug. 20, 1973 Sweden ..... 7311325

[52] U.S. Cl. ..... 204/288; 29/195; 29/196; 29/199; 204/268; 204/290 F

[51] Int. Cl.[2] ..... C25B 11/06; C25B 11/10

[58] Field of Search ..... 204/290 F, 268, 288, 204/286; 29/195 M, 196, 199

[56] References Cited

UNITED STATES PATENTS

| | | | |
|---|---|---|---|
| 3,337,443 | 8/1967 | Raetzsch et al. | 204/256 |
| 3,410,784 | 11/1968 | Mausell et al. | 204/268 |
| 3,563,878 | 2/1971 | Grotheev | 204/256 |
| 3,755,105 | 8/1973 | Messner | 204/95 |
| 3,759,813 | 9/1973 | Raetzsch et al. | 204/256 |
| 3,759,815 | 9/1973 | Larsson | 204/208 |
| 3,884,792 | 5/1975 | McGilvery | 204/290 F |

*Primary Examiner*—F.C. Edmundson
*Attorney, Agent, or Firm*—Fred Philpitt

[57] ABSTRACT

An electrode or electrode assembly comprising an anode of titanium, a cathode of iron or steel and a layer intermediate said anode and cathode comprising silver or gold.

2 Claims, 2 Drawing Figures

ELECTRODE ASSEMBLY

BACKGROUND

Figure 1:
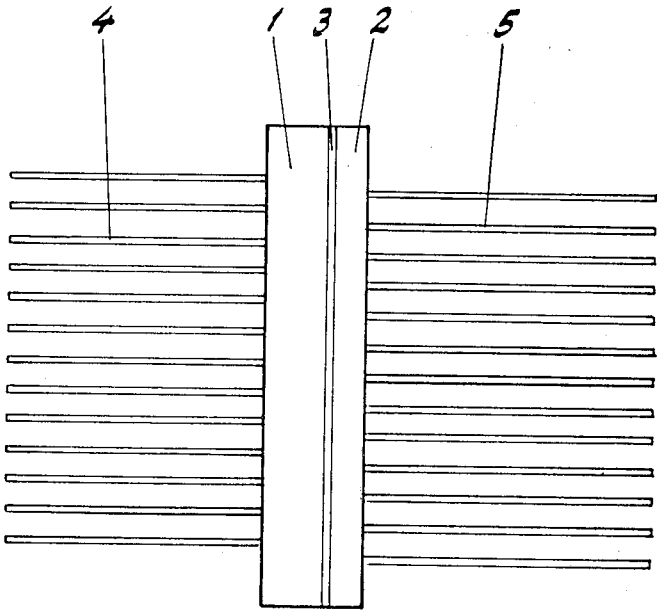

In the U.S. Pat. No. 3,759,815 I have disclosed an electrode assembly for use in an electrolyzing cell comprising a bimetallic base plate from which parallel electrode plates extend. One metal of the bimetallic base plate and the protruding electrode plates serves as the cathode while the other metal and its protruding electrode plates serves as the anode. A number of these electrode assemblies can be arranged in a substantially parallel relationship within a cell box so as to form separate cell units in an electrolyzing cell.

Titanium is preferably used as the anodic material in the base plate and iron or steel in the cathodes. The titanium surfaces have to be provided with a thin coating of anodically-resistant electroconductive coating, such as of the platinum-group metal or of an oxide or mixture of oxides of these metals (e.g. platinum, ruthenium, rhodium, palladium, osmium, iridium and alloys of two or more of these metals) i.e. DSA-electrodes.

Bipolar electrodes and electrode assemblies of this kind may be used in either the filter press type or in the so-called PPG-system type (U.S. Pat. No. 3,203,882) and in diaphragm cells as well.

THE PROBLEM

A complicating factor in the construction of bipolar electrodes for these cell types is that the cathodic reaction at the electrolysis involves hydrogen gas development as a main or a bireaction and the atomic (nuclear) hydrogen will dissolve in the cathode material. The atomic hydrogen will diffuse through the cathodic material to the anodic material and form metal hydrides with the latter. Especially when titanium and related metals are used as the anodic material there will be great problems, as the formation of needle-shaped hydride crystalites means deformation and embrittlement of the material. These problems occur for example in the electrolysis of sodium chloride to sodium chlorate and chlorine electrolysis using bipolar diaphragm cells. Several methods have been suggested to prevent these disadvantages.

THE PRESENT INVENTION

According to the present invention these disadvantages are eliminated by providing a hydrogen-impermeable barrier of a metal selected from the group consisting of silver and gold between and intimately joined (laminated) with both the anodic metal and cathodic metal, i.e. between the titanium layer and the iron layer of the base plate. In practice silver is preferred for the reasons of cost. The thickness of the hydrogen impermeable intermediate barrier is preferably within the range of 0.05–3 mm. A bipolar electrode according to the invention thus comprises a titanium anode layer, a silver layer and an iron or steel cathodic layer intimately joined together. The three layers may be joined by means of pressure, such as by rolling, or pressing or by metal cladding, i.e. by means of explosive forces. Using the metal cladding operation silver is very suitable since the joining can be accomplished without any additional explosive operation and other positive bi-effects are obtained. Thus the amount of the explosive can be reduced and eventual micropores in the anodic and cathodic materials are compacted and the chance for cavities in the junction are reduced.

Figure 2:
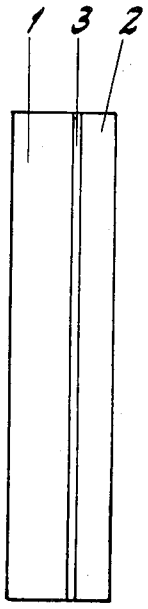

The invention will be described more in detail in connection with the drawings, wherein FIG. 1 shows a bipolar electrode element in a cell of the PPG-type and FIG. 2 shows the corresponding element in a filter press type. The reference numerals apply to both the figures.

As is shown in FIG. 1 the anodic 1 and cathodic 2 base layers have been brought together with an intermediate diffusion barrier 3 to form a base plate. The electrode plates 4, which are made of the same metal as 1 but provided with an activating coating, (e.g. a platinum metal or a platinum metal oxide) project from the anodic base 1. The electrode plates 5 project in the same way from the cathodic base 2. The plates 5 and the base 2 are here of the same material.

Also, the cathode plates 5 may be provided with an activating coating. In the case of the PPG-system type assembly the base layers 1 and 2 do not participate in the electrolysis.

The reverse is the case in FIG. 2 which illustrates the bipolar element in the filter press type assembly. As before 1 is the anodic base layer, 2 the cathodic base layer and 3 the diffusion barrier. The anode base is provided with an activating coating on its exposed surface. The cathode base can also be provided with a conductive coating of a material having low $H_2$-overpotential. The base metals serve here as active electrode surfaces.

What I claim is:

1. An improved electrode assembly comprising a. an anodic base plate comprising a layer of titanium, b. a cathodic base plate comprising a layer of iron or steel, c. a plurality of titanium anodes extending outwardly from the anodic base plate, d. a plurality of cathodes of iron or steel extending outwardly from the cathodic base plate, e. a layer consisting of silver interposed between said anodic base plate and said cathodic base plate, f. the layers set forth in (a), (b), and (e) being joined together in a laminate so that the silver layer forms a $H_2$-impermeable barrier between the anodic base plate and the cathodic base plate, the active titanium surface being coated with a conductive metal.

2. A bipolar electrode which comprises a three layer lamination comprising an anodic layer of titanium, a cathodic layer of iron or steel and an intermediate layer of silver, the active titanium surface being coated with a conductive material.

* * * * *